United States Patent [19]

Hermanson

[11] 4,341,242

[45] Jul. 27, 1982

[54] LOADING ARM

[75] Inventor: Dean E. Hermanson, Richardson, Tex.

[73] Assignee: Continental Emsco Company, Dallas, Tex.

[21] Appl. No.: 203,408

[22] Filed: Nov. 3, 1980

[51] Int. Cl.[3] ..... B65B 3/04

[52] U.S. Cl. ..... 137/615; 141/387

[58] Field of Search ..... 141/387, 388, 279; 414/139, 719; 137/615

[56] References Cited

U.S. PATENT DOCUMENTS

| | | | |
|---|---|---|---|
| Re. 25,855 | 9/1965 | Mowell et al. | 137/615 |
| 3,085,593 | 4/1963 | Sorensen | 137/615 |
| 3,340,907 | 9/1967 | Bily | 137/615 |
| 3,362,432 | 1/1968 | Jameson | 137/615 |
| 3,434,491 | 3/1969 | Bily | 137/615 |
| 3,590,870 | 7/1971 | Ashton | 137/615 |
| 4,093,003 | 6/1978 | Miller et al. | 137/615 |
| 4,142,551 | 3/1979 | Wilms | 137/615 |
| 4,190,080 | 2/1980 | LeDevehat | 141/387 |

*Primary Examiner*—A. Michael Chambers

*Attorney, Agent, or Firm*—Stephen S. Sadacca; Thomas F. Daley; James M. Cate

[57] ABSTRACT

A loading arm utilizing a counterbalancing mechanism in which half sheaves are utilized to provide one interconnection between the counterbalance and the outboard arm and a member is pivotally connected to both the outboard arm and the counterbalance to provide the other interconnection between the counterbalance and outboard arm to provide for full retracted storage of the arm. Preferably, rods provide the majority of the interconnection between the outboard arm and the counterweight.

5 Claims, 2 Drawing Figures

LOADING ARM

This invention relates to loading arms.

Loading arms as previously constructed are illustrated in U.S. Pat. No. 3,590,870, No. 3,085,593, Re. 25,855, and on Page 1268 of the 1974–75 issue of *The Composite Catalog of Oil Field Equipment and Services, 31st. Rev.* Loading arms of these types are subject to the disadvantages discussed below.

A marine loading arm is normally counterbalanced. The term counterbalance means that both the inboard and outboard legs are counterbalanced by either one single weight or two separate weights. The reason for counterbalancing includes ease of manual handling, reduction of loads on ship's manifold, and reduction in power for hydraulic assist. The counterbalance movement is a function of the counterbalance weight, the lever arm and the phase relationship of the arm and/or weight.

Some loading arms use a circular sheave with wireline to effect the advantage of a large constant lever arm and the resulting efficiency for the counterbalance weight. However, wireline is subject to constructional stretch as well as elastic stretch. Conventional wireline undergoes significant relaxation due to constructional stretch. The stretch changes the phase relationship of the weight, causing the arm to go out of balance, making the arm difficult to maneuver, causing possible failure of the hydraulic system to move the arm because of the extra power required and the higher loads on the ship's manifold.

In addition, in the stored position, because of the fixturing of the wireline to the lower sheave, the wireline lifts off the sheave causing a change in the lever arm or imperfect balance with resulting maneuvering problems.

A way to minimize this stretch is to prestress the wireline several times before installation. Even with prestressing the wireline continues to relax but to a much smaller degree under continued usage.

Some loading arms utilize pipe as a connecting link. Pipe can restrict movement. Also, because of a changing effective lever arm length, counterbalance force can become high, resulting in large diameter, heavy pipes. Pipe does have the advantage of eliminating constructional, but not elastic, stretch. In some arm attitudes the pipe is in compression and must be supported to bring the L/R ratio into acceptable engineering parameters. This results in added weight and complexities.

An object of this invention is to substantially eliminate the effect of constructional stretch in the counterbalance system of a loading arm.

Another object is to completely eliminate constructional stretch in one of the means tying the counterbalance to the outboard arm permitting the loading arm to be properly phased at the fractory and to be maintained in phase by adjustment of the second means interconnecting the counterbalance and outboard arm.

Another object is to provide a counterbalance system for a loading arm having two interconnecting means on opposite sides of the inboard arm in which out-of-phasing is minimized or eliminated.

Another object is to provide a counterbalancing system for a loading arm employing sheaves in which the cables are always in contact with the sheave at the point where the cable is tangent to the sheave in any position of the loading arm to maintain a constant lever arm at the sheaves and maintain a constant counterbalance in all positions of the arm.

Other objects, features and advantages of the invention will be apparent from the drawing, the specification and the claims.

In the drawing wherein an illustrative embodiment of this invention is shown,

Figure 1:
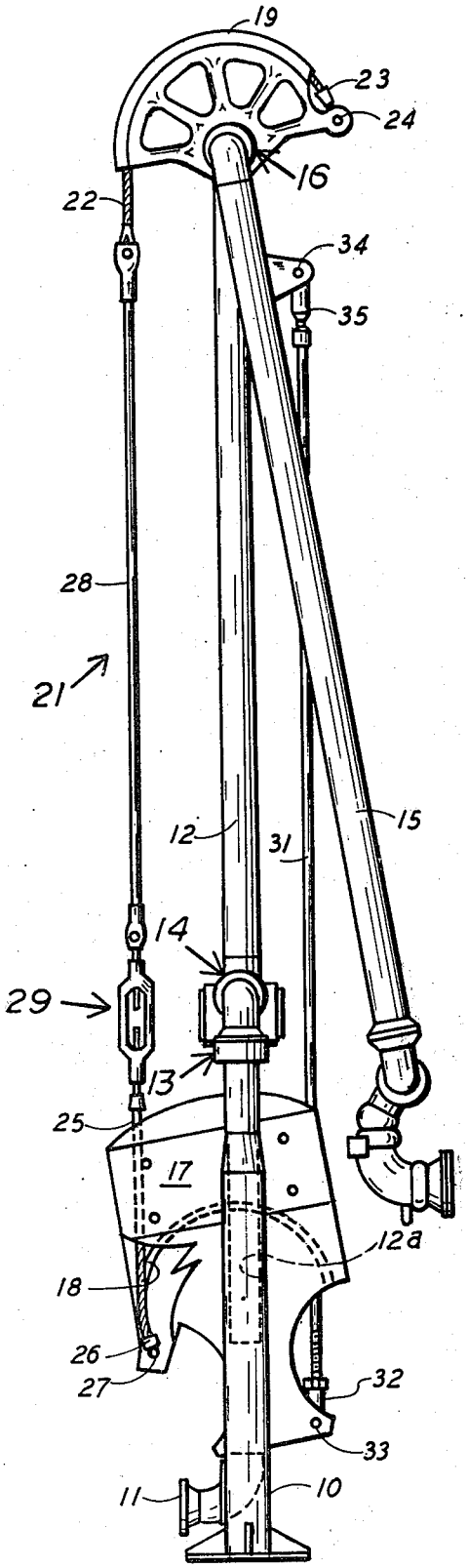
FIG. 1 is a view in elevation of a loading arm constructed in accordance with this invention with parts broken away to illustrate details and with hidden structure indicated by dashed lines.

The loading arm includes a riser 10 which may take any desired form for supporting the structure. An inlet conduit 11 is carried by the riser and conducts fluid to the inboard and outboard arms.

An inboard arm 12 is supported on the riser. The support includes a swivel joint indicated generally at 13, providing for rotation of the inboard arm about a vertical axis. The system includes a second swivel joint indicated generally at 14 which provides for rotation of the inboard arm about a horizontal axis. The support of the inboard arm may follow the teaching of U.S. Pat. No. 3,590,870, which is incorporated herein by reference in its entirety.

An outboard arm 15 is supported on the inboard arm for rotation about a horizontal axis in the conventional manner by a suitable swivel joint indicated generally at 16.

A counterweight 17 is rotatably mounted on the tailpipe (shown in dashed lines at **12*a*) of inboard arm 12 in the manner taught by U.S. Pat. No. 3,085,593, the disclosure of which is incorporated herein by reference in its entirety. The counterweight 17 counterbalances both the inboard and outboard arms in any operative position of the arms. As will be understood by those skilled in the art, the outboard arm 15 and the counterweight 17 are phased such that the centerline of the outboard arm and the centerline passing through the center of rotation of the counterweight 17 are parallel. If this phase relationship be maintained in all positions of the arm, then the arm will be counterweighted in all positions to the same extent by the counterweight 17**.

The counterweight carries a half sheave 18. This sheave will preferably extend through an arc of approximately 180° to provide an ample angular distance such that the moment arm exerted by the sheave will always be the same. Depending upon the degree of extension of the inboard and outboard arms the sheave might have a different arcuate dimension but it is preferably approximately 180° so that the inboard arm can extend from the vertical position shown to almost a horizontal condition. The sheave 18 is mounted for rotation about an axis coaxial with the center of rotation of the counterweight.

A second sheave 19 is carried by the outboard arm 15 with the center of rotation of the sheave coaxial with the horizontal axis of rotation of the outboard arm. Again, this sheave will have an arcuate dimension of approximately 180° and as with the sheave 18 will provide a constant length moment arm in all operative positions of the loading arm.

The sheaves 18 and 19 are of equal size, that is, their radial distance from the center of rotation is the same so that the moment arm provided by the sheaves will be equal. A means indicated generally at 21 interconnects the two sheaves 18 and 19. This means 21 includes a short cable 22 which is trained over the sheave 19 and remains in contact with the sheave at the point where the cable 22 is tangential to the sheave in all operative positions of the loading arm. It will be noted that the cable 22 has a conventional end fitting 23 which is secured to an ear 24 in the conventional manner. The sheave track or groove begins adjacent to the fitting 23 to provide clearance for the fitting 23. Preferably, the cable 22 is minimal in length and is only long enough to provide ample cable for contact with the sheave 19 in any operable position.

The means 21 also includes a short cable 25 which is trained over sheave 18. The cable includes a connector 26 which is connected to the counterweight at 27. The cable 25 is preferably of a length to engage the sheave 18 at the point of tangency in all operative positions of the arm.

The connecting means 21 includes a rod 28 which carries on one end a turnbuckle indicated generally at 29. The rod and turnbuckle are connected to the ends of cables 22 and 25. The rod 28 is preferably of maximum length consistent with the cables 22 and 25 being able to maintain their contact with their associated sheaves at their respective point of tangency to the sheaves to reduce as much as possible the problems associated with constructional stretch of cables. The rod 28 may be a solid rod or may be a hollow pipe of any desired cross-sectional configuration. Thus, rod 28 may be any type of member which is not subject to constructional stretch.

A second rod 31 is pivoted to the outboard arm and to the counterweight. By providing a direct pivotal connection instead of using sheaves the problems associated with a single 360° sheave and two cables are eliminated. In particular, the problem of lifting off of the cable from the sheave at extreme positions of the loading arm is eliminated and the moment arms provided in the counterweight system remain constant. As with the rod 28 the rod 31 may be of any form or configuration so long as it is not subject to constructional stretch. The rod 31 is provided with threads at at least one end and carries a yoke 32 on the threaded end of the rod. The yoke is pivoted to the counterweight by pivotal connection 33. The threaded rod and associated yoke 32 permits the effective length of rod 31 to be varied to establish proper phasing of the outboard arm 15 and the counterweight 17. The upper end of rod 31 is connected to the outboard arm 15 by pivot 34. If desired, the connection between the rod 31 and the pivotal connector 35 may also provide for adjustment in length of the rod 31.

Figure 2:
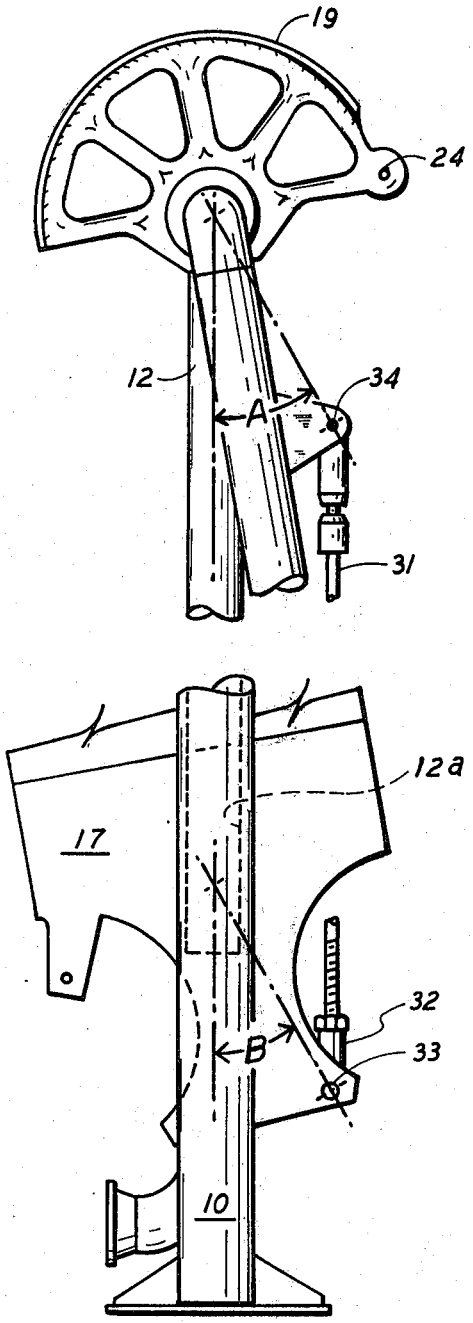
FIG. 2 is a fragmentary view similar to FIG. 1 illustrating the moment arms and angular relationship of the pivotal connection of the rod to the outboard arm and to the counterweight.

Referring to FIG. 2, it will be noted that to properly phase the counterweight 17 and the outboard arm 15 about their respective pivot points, it is necessary to assure that the angle A between the pivot point 34 and the centerline of the inboard arm is equal to angle B which is the angle between the pivot point 33 and the centerline of the inboard arm. The distance from the pivot point 34 to the center of rotation of the outboard arm is equal to the distance from pivot point 33 to the center of rotation of the counterweight 17 and the sheave 18. As these angles and moment arms are identical and the two rods 28 and 31 are maintained in parallel relationship by full engagement of the cables 22 and 25 with their respective sheaves at the point of tangency, the effect of the counterweight 17 will be the same in any operative position of the loading arm.

Loading arms are customarily assembled at the point of use. They are conventionally preassembled and then dismantled at the factory to adjust and test the operation of the arm before shipment.

In the past it has been conventional to prestretch cables in counterbalance systems to eliminate as much as possible the effects of constructional stretch. Even with prestressing relaxation of the cables with use provides problems in the field.

With the instant invention the employment of the solid rod 31 permits phasing of the system in the factory without regard to constructional or relaxation stretch which is found in cables and the loading arm may be properly phased in the factory and should remain properly phased thereafter. Any relaxation of the cables which occurs in the cables 22 and 25 may be compensated for by tightening the turnbuckle 29. If with use it is found that phasing of the system has changed a mere repositioning of the yoke 32 on the rod 31 will return the system to the proper phasing relationship.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A loading arm comprising, a riser, an inboard arm supported on the riser and including means allowing rotation about first horizontal and vertical axes, an outboard arm supported on the inboard arm and including means allowing rotation about a second horizontal axis, a counterweight rotatably mounted on the inboard arm for counterbalancing the inboard and outboard arms, a first half sheave mounted on the counterweight with its center of rotation coaxial with the center of rotation of the counterweight, a second half sheave mounted on the outboard arm with its center of rotation coaxial with the second horizontal axis of rotation of the outboard arm, said first and second sheaves of equal size, first means including cables trained over one side of said first and second sheaves connecting the counterweight to the outboard arm, and second means pivoted to and interconnecting the counterweight and said outboard arm and including a pair of respective pivot points, said pivot points spaced equal distances from the respective centers of rotation of said counterweight and outboard arm and at equal distances from the centerline of said inboard arm in all positions of said outboard arm, said centerlines of said outboard arm and counterweight being parallel, said centerlines of said counterweight and said outboard arm extending through their axes of rotation.

2. The loading arm of claim 1 wherein means are provided for adjusting the effective length of each of the two means for interconnecting the outboard arm and the counterweight.

3. A loading arm comprising, a riser, an inboard arm supported on the riser and including means allowing rotation about first horizontal and vertical axes, an outboard arm supported on the inboard arm and including means allowing rotation about a second horizontal axis, a counterweight rotatably mounted on the inboard arm for counterbalancing the inboard and outboard arms, a first half sheave mounted on the counterweight with its center of rotation coaxial with the center of rotation of the counterweight, a second half sheave mounted on the outboard arm with its center of rotation coaxial with the second horizontal axis of rotation of the outboard arm, said first and second sheaves of equal size, a cable secured to the outboard arm and trained over the outboard arm sheave, a cable secured to the counterweight and trained over the counterweight sheave, a rod interconnecting said cables, a second rod pivoted to said counteweight and to said outboard arm and including a pair of respective pivot points, said pivot points spaced equal distances from the respective centers of rotation of said counterweight and outboard arm and at equal distances from the centerline of said inboard arm in all positions of said outboard arm, said centerlines of said outboard arm and counterweight being parallel, said centerlines of said counterweight and said outboard arms extending through their axes of rotation.

4. The loading arm of claim 3 wherein means are provided for adjusting the effective lengths of said two cables and associated rod.

5. The loading arm of claim 3 wherein means are provided for adjusting the effective lengths of said two cables and associated rod and said pivoted rod.

* * * * *